US007380681B2

(12) United States Patent
Reutter

(10) Patent No.: US 7,380,681 B2
(45) **Date of Patent: *Jun. 3, 2008**

(54) SEALING LID FOR MOTOR VEHICLE RADIATOR

(76) Inventor: Heinrich Reutter, Theodor-Heuss-Strasse 12, 71336, Waiblingen (DE)

( * ) Notice: Subject to any disclaimer, the term of this patent is extended or adjusted under 35 U.S.C. 154(b) by 409 days.

This patent is subject to a terminal disclaimer.

(21) Appl. No.: 10/502,396

(22) PCT Filed: Jan. 23, 2003

(86) PCT No.: PCT/EP03/00639

§ 371 (c)(1),
(2), (4) Date: Jul. 26, 2004

(87) PCT Pub. No.: WO03/062613

PCT Pub. Date: Jul. 31, 2003

(65) Prior Publication Data

US 2005/0082289 A1 Apr. 21, 2005

(30) Foreign Application Priority Data

Jan. 24, 2002 (DE) ..... 202 01 082 U

(51) Int. Cl.
*B65D 51/16* (2006.01)

(52) U.S. Cl. ..... 220/203.27; 220/303; 220/DIG. 32; 220/DIG. 33; 220/201

(58) Field of Classification Search ..... 220/DIG. 32–DIG. 33, 201, 203.27, 303, 203.19, 203.22
See application file for complete search history.

(56) References Cited

U.S. PATENT DOCUMENTS 2,551,058 A * 5/1951 Selzler et al. ..... 220/847
3,053,408 A * 9/1962 Rodgers ..... 220/203.06
3,164,288 A * 1/1965 Boomgaard ..... 220/203.24
3,587,912 A * 6/1971 Ohta et al. ..... 220/231

(Continued)

FOREIGN PATENT DOCUMENTS

DE 197 05 036 A 1 8/1998

(Continued)

*Primary Examiner*—Anthony Stashick
*Assistant Examiner*—Christopher McKinley
(74) *Attorney, Agent, or Firm*—Bacon & Thomas, PLLC

(57) ABSTRACT

A sealing lid for the fixed nozzle of a container, particularly a motor vehicle radiator, comprising an outer part and an inner part. The outer part of the lid is provided with a sealing element for the container nozzle and a grip element which is rotatable in relation thereto. A torsional stop acts between the grip element and the sealing element of the outer part of the lid. The inner part of the lid is provided with a flow connection between the inside and outside of the container and a valve system opening and closing the flow connection. The torsional stop which can be disengaged by applying prestress to a spring or is disengaged, can be engaged by a pressure-controlled drive in the form of a membrane. The drive is positioned in the outer part of the lid and is provided with an elongate pressure-transmitting element which penetrates the pressure relief valve body in the lid axis and extends into the area of the inner part of the lid, which is connected to the container nozzle so as to interact therewith. The suction relief valve body is arranged concentrically to the lid axis.

16 Claims, 2 Drawing Sheets

U.S. PATENT DOCUMENTS 3,820,680 A * 6/1974 Friend ..... 220/288
4,079,855 A * 3/1978 Avrea ..... 220/203.26
4,185,751 A * 1/1980 Moore et al. ..... 220/203.26
4,241,845 A * 12/1980 Daly et al. ..... 220/203.26
4,498,599 A * 2/1985 Avrea ..... 220/203.26
4,676,390 A * 6/1987 Harris ..... 220/203.06
4,726,488 A * 2/1988 Kasugai ..... 220/203.25
4,887,733 A * 12/1989 Harris ..... 220/203.06
4,913,303 A * 4/1990 Harris ..... 220/203.21
5,036,888 A * 8/1991 Scharrer et al. ..... 138/89
5,108,001 A * 4/1992 Harris ..... 220/203.06
5,110,003 A * 5/1992 MacWilliams ..... 220/304
5,148,934 A * 9/1992 Kasugai et al. ..... 220/203.25
5,163,506 A * 11/1992 Attinger et al. ..... 165/104.32
5,169,015 A * 12/1992 Burke ..... 220/203.07
5,174,463 A * 12/1992 Scharrer ..... 220/203.26
5,183,173 A * 2/1993 Heckman ..... 220/203.07
5,248,052 A * 9/1993 Mellinger et al. ..... 220/202
5,269,431 A * 12/1993 Sakata et al. ..... 220/203.17
5,279,439 A * 1/1994 Kasugai et al. ..... 220/203.23
5,480,055 A * 1/1996 Harris et al. ..... 220/203.26
5,520,300 A * 5/1996 Griffin ..... 220/210
5,522,456 A * 6/1996 Valk ..... 165/104.32
5,941,407 A * 8/1999 De' Longhi ..... 220/316
5,971,203 A * 10/1999 Bae ..... 220/746
6,178,930 B1 * 1/2001 Triberti ..... 123/41.15
6,364,145 B1 * 4/2002 Shaw et al. ..... 220/203.11
6,390,318 B1 * 5/2002 Tanaka et al. ..... 220/203.26
6,971,533 B2 * 12/2005 Reutter ..... 220/201
2002/0153375 A1 * 10/2002 Harris ..... 220/203.24
2003/0185276 A1 * 10/2003 Reutter ..... 374/146
2004/0040966 A1 * 3/2004 Watanabe et al. ..... 220/298
2004/0056034 A1 * 3/2004 Reutter ..... 220/303
2005/0082289 A1 * 4/2005 Reutter ..... 220/203.27

FOREIGN PATENT DOCUMENTS

DE 197 53 597 A 1 6/1999
DE 199 23 775 A 1 11/2000
DE 200 12 722 U 1 1/2002
EP 0 995 888 A 1 4/2000
WO WO 01/75282 10/2001

* cited by examiner

SEALING LID FOR MOTOR VEHICLE RADIATOR

FIELD OF THE INVENTION

The invention related to a closure cap for a fixed neck of a container, in particular a motor vehicle radiator, having an outer cap element and an inner cap element. The outer cap element has a closure element for the container neck and a grip element which can be rotated relative to the closure element. A twist-prevention device is provided which acts between the closure element and the grip element, and a valve arrangement is provided serving to release or block a flow connection defined by the cap element between the interior of the container and the exterior of the container. The valve arrangement has an axially movable overpressure valve body which is pressed under initial tension toward the interior of the container against a seal at the inner can element in such a way that, when a threshold value of the interior container pressure is exceeded, it can be lifted off the seal, and the underpressure valve body.

BACKGROUND OF THE INVENTION

In such a closure cap known from DE 197 53 597 A1, the twist-prevention device between the closure element and the grip element is constituted by an axial coupling bolt, which is acted upon by a spring arrangement which operates as a function of temperature.

In connection with a further closure cap known from DE 199 23 775 A1, the twist-prevention device is constituted by a strap, which is axially movable and is arranged inside the grip element and can be operated by a thermal drive in the form of an expandable material. In both these known cases it is difficult to transmit the actual heat in the container to the twist-prevention device, which can be affected by heat, without considerable temperature losses. This is difficult to obtain, not least because of the valve arrangement in the form of an overpressure or underpressure valve arranged in the path between the container interior and the twist-prevention device. This correspondingly also applies to those closure caps which, as already suggested, operate by means of a pressure-controlled twist-prevention device.

SUMMARY OF THE INVENTION

It is the object of the present invention to provide a closure cap for a fixed neck of a container, in particular a motor vehicle radiator, of the type mentioned at the outset, to whose twist-prevention device, or its drive mechanism, it is possible to transmit the temperature in the container interior, or the pressure in the container interior, to the twist-prevention device, or its drive mechanism, in a simpler manner and without impermissibly high losses.

The twist-preventing element is disengaged by means of a thermally or pressure-controlled drive mechanism in the form of a capsule made of an expandable material, or of a diaphragm. The drive mechanism is arranged in the outer cap element and is provided with a linearly extending transmitting element which penetrates the overpressure valve body in the cap axis and extends into the area of the inner cap element which is connected with the neck of the container and that the underpressure valve body is arranged concentrically with respect to the cap afix. This arrangement is provided to attain this object in connection with a fixed neck of a container, in particular a motor vehicle radiator, of the type mentioned.

By means of the steps in accordance with the invention it has been achieved that the drive element in the form of a capsule made of an expandable material, or a diaphragm, and operating as a function of temperature or a function of pressure, can pick up the temperature prevailing in the container interior, or the pressure prevailing in the container interior, without losses and without delay. The transmission of the temperature and pressure conditions in the container interior can be done in the shortest and most direct way directly in the course of the cap access, without having to tolerate disadvantages in the action of the overpressure valve body and especially in the action of the underpressure valve body. Because of the concentric disposition of the underpressure valve body, a short construction of the inner cap element is also achieved.

In a first preferred exemplary embodiment of the present invention in accordance with which the underpressure valve body is integrated with the twist-prevention device. The space inside the cap, that is, between the grip element and closure element, is advantageously used for the underpressure valve body. This does not cause any increase in structural height.

Advantageous features in this respect are defined by the fact that the twist-prevention device is formed by a blocking plate, in the middle region of which, oriented forward the pressure-controlled or thermally-controlled drive mechanism, the underpressure valve body is retained in axially spring-loaded fashion; and/or the underpressure valve body is retained axially movable in a central bore in the blocking plates, and a compression spring acting between the underpressure valve body and the top of the blocking plate presses an annular sealing face of the underpressure valve body against the underside of the blocking plate.

In a second preferred exemplary embodiment of the present invention the underpressure valve body surrounds the elongated pressure- or temperature-transmitting element, preferably near the free end of the inner cap element. The underpressure valve body is disposed in the course of the pressure- or temperature-transmitting element. Once again, this does not increase the structural height.

In a preferred way, the underpressure valve body is integrated with the overpressure valve body. This results in a simplified structural embodiment and simplified installation of the underpressure valve body together with the overpressure valve.

While this last embodiment of the underpressure valve body integrated with the overpressure valve can advantageously be used and is possible with both pressure- and temperature-controlled driving of the twist-prevention device, the installation and use of the underpressure valve body disposed between the grip element and closure element is especially advantageous in the pressure-controlled embodiment of the twist-prevention device.

An advantageous feature of the pressure- or temperature-transmitting element is obtained by embodying it as a hollow or solid rod, along whose outer circumference the overpressure valve body, prestressed by an axial compression spring, is guided.

Preferred and advantageous features in terms of the integration of the underpressure valve body and overpressure valve body are characterized in that between an annular sealing sent for the overpressure valve body, on a centrally pierced bottom of the inner cap element, and the underside, remote from the axial compression spring, of the overpressure valve body, the liftable outer circumferential require of a sealing diaphragm is disposed, whose inner circumferential region brinas about an overpressure sealing that is constantly axially operative for the overpressure valve body between the overpressure valve body and the elongated pressure- or temperature-transmitting element, and characterized in that the inner circumferential region of the sealing diaphragm can be lifted away counter to the action of a compression spring that acts in the direction of an overpressure, and characterized in that the inner circumferential region of the sealing diaphragm is pressed against a shoulder of the elongated pressure- or temperature-transmitting element, and the compressing spring is braced on the bottom of the inner cap element.

Further features of the pressure-transmitting element, its diaphragm, and the twist-prevention device are characterized in that the pressure-transmitting element has a through bore, whose inlet side, toward the container, discharges at the bottom of the inner cap element, and whose outside, remote from the container, is covered by the diaphragm in that the diaphragm, with its central region, is opposite the outlet side of the through bore. is fastened in Diace in pressure-proof fashion on the outer circumference, and on the inner circumference rests between the underside of the blocking plate and the annular sealing face of the underpressure valve body, and in that the diaphragm is fastened in place on the circumferential region of all end flange of the pressure-transmitting element, and in that the inner cap element has a centrally pierced false bottom, on the top of which the flange, provided with the diaphragm, or the capsule made of expandable material rests, and from whose underside the valve arrangement is suspended, and in that the blocking plate is connected nonrotatably but axially movably to the closure element, and that radially outward-point prongs of the blocking plate become engaged between readially inward-pointing prongs of the grip element.

Further details of the invention can be found in the description which follows, in which the invention is described in greater detail and explained by means of exemplary embodiments shown in the drawings. Shown are in:

DESCRIPTION OF THE PREFERRED EMBODIMENT

Figure 1:
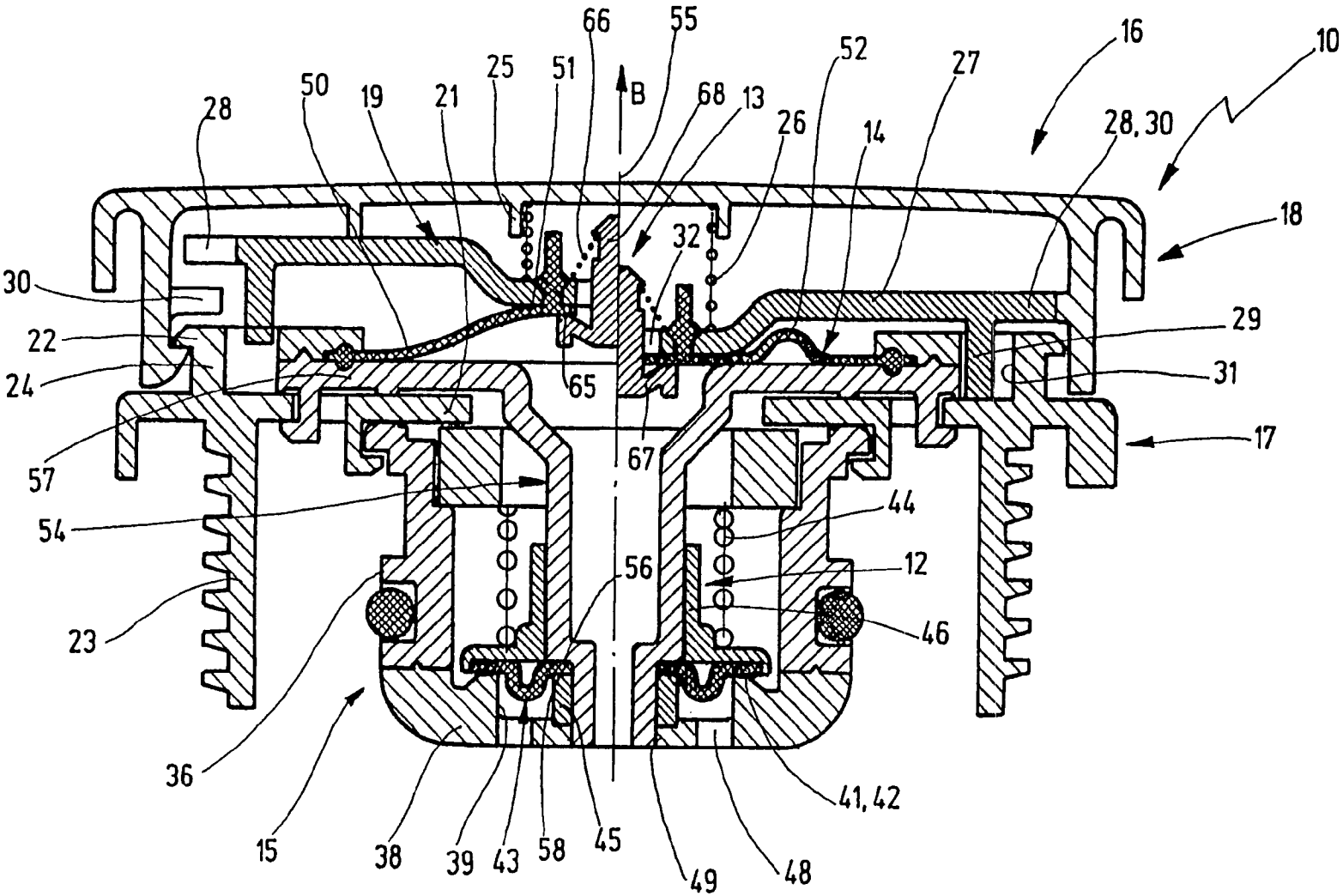
FIG. 1, a schematic representation in longitudinal section of a closure cap for a motor vehicle radiator with a pressure controlled twist-prevention device in accordance with a first exemplary embodiment of the present invention, the right and left half-sections respectively representing one of the two end positions, and FIG. 2, a representation corresponding to FIG. 1, but with a closure cap with a temperature controlled twist-prevention device in accordance with a second exemplary embodiment of the present invention.
Figure 2:
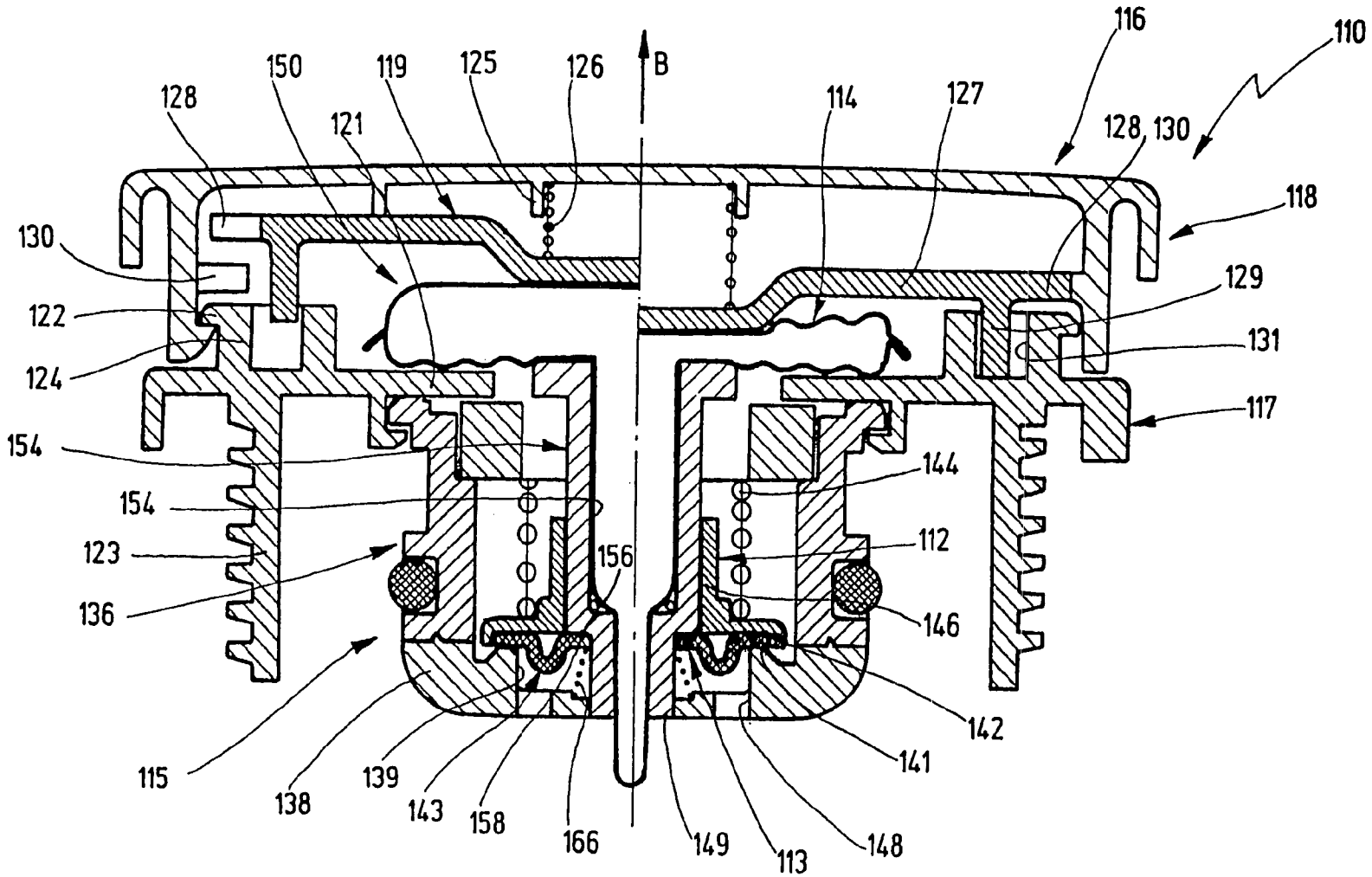

The closure cap 10 or 110, shown in the drawings in two exemplary embodiments, has an overpressure/underpressure valve arrangement 11 or 111, which has an overpressure valve body 12 or 112 and an underpressure valve body 13 or 113, which in the exemplary embodiment of FIG. 1 are formed by components disposed at different places and in the exemplary embodiment of FIG. 2 are formed by components connected to one another or integrated with one another. The opening pressure of the overpressure valve body 12, 112 is fixedly set by means of a helical compression spring 44, 144, and the opening pressure of the underpressure valve body 13, 113 is likewise fixedly set by means of a helical compression spring 66, 166.

In accordance with the representation in the drawings, the outer lid 16 or 116, which is identical in both exemplary embodiments, of the closure cap 10 or 110 has a closure element 17, 117, which is here in the form of an exterior thread element for screwing the closure cap onto or off the opening of a neck, not shown here, of a motor vehicle radiator or other container, and a grip element 18, 118, which is rotatable in relation to the closure element 17, 117 and can be connected with it, fixed against relative rotation, by means of a twist-prevention device 19, 119, which is identical in both exemplary embodiments. A drive mechanism 14, 114 for disconnecting the twist-prevention device 19, 119 is arranged, the same as the latter itself, in a space between the grip element and the closure element 18 and 17, or 118 and 117. It is understood that the closure element 17, 117 can also be embodied as a quarter-turn fastener instead of as an exterior thread element.

The closure element 17, 117 has an intermediate bottom 21, 121 provided with an axial opening, from whose underside a sleeve 23, 123 with an exterior thread, and from whose top a connecting sleeve 24, 124 project axially, by means of whose radial flange 22, 122 the closure element 17, 117 is rotatably maintained at the grip element 18, 118, but is kept suspended axially immovable. The grip element 18, 118 extends underneath the outer edge of the flange 22, 122 of the connecting sleeve 24, 124 of the closure element 17, 117 and has in its center a guide ring 25, 125, which projects axially inward and within which a compression spring 26, 126 is received, whose one end is supported on the inside of the grip element 18, 118, and its other end on a blocking plate 27, 127 of the twist-preventing element 19, 119. The blocking plate 27, 127, in both axial positions, is connected to the closure element in a manner fixed against relative rotation, specifically by means of outer, axially downward-protruding claws 29, 129, which mesh constantly with axial grooves 31, 131 in the closure element 17, 117. The blocking plate 27, 127 furthermore has radially protruding prongs 28, 128 on the outer circumference, which in one end position (right half-section) become engaged between retaining prongs 30, 130 that protrude radially inward from the grip element 18, 118. In this position, the twist-prevention device 19, 119 is connected in a manner fixed against relative rotation not only to the closure element 17, 117 but also to the grip element 18, 118, which allows the closure cap to be screwed onto or off the container neck, not shown. As will still be shown, the twist-preventing element 19, 119 can be axially moved against the action of the compression spring 26, 126 in such away that the prongs 28, 128 are released from the interstices between the retaining prongs 30, 130 (left half-section), so that the rotating connection between the twist-prevention element 19, 119 and the grip element 18, 118 is released, which results in a free-wheeling rotation of the grip element 18, 118 on the closure element 17, 117 and prevents the unscrewing of the closure cap 10, 110 from the container neck.

An inner cap element 15, 115, which holds the overpressure valve body 12, 112 of the valve arrangement 11, 111, is suspended from the closure element 17, 117 of the outer cap element 16 or 116 in such a way that the inner cap element 15, 115 is axially immovable in respect to the outer cap element 16, 116, but can be rotated in the circumferential direction. The inner cap element 15, 115 has a valve cup 36, 136, which is suspended from the closure element 17, 117 and has radial flow-through openings, not shown. A bottom 38, 138 of the valve cup 36, 136 is provided with an inner opening 39, 139, around which an annular sealing face 41, 141 is provided, which is axially raised toward the interior, the overpressure valve body 12, 112 rests with a radially outer sealing face 42, 142 of a sealing diaphragm 43, 143 on the annular sealing face 41, 141 by means of the action of the compression spring 44, 144, which has a defined initial tension. The overpressure valve body 12, 112 is approximately hat-shaped, and the sealing diaphragm 43, 143 is received inside of its brim, which is axially bent inward on its periphery toward the bottom 38, 138. The sealing diaphragm 43, 143, whose outer circumferential region or radially outer sealing face 42, 142 rests on the annular sealing face 41, 141, is retained in fixed fashion on its inner circumferential region or radially inner sealing face 58, 158, in the exemplary embodiment of FIG. 1, but conversely in the exemplary embodiment of FIG. 2 is retained in openable fashion by the action of a compression spring, as will be described hereinafter. The inner central blind-bore recess 39, 139 in the bottom 38, 138 communicates via connecting openings 48, 148 with the interior of the container, not shown, or its container neck.

The drive mechanism 14, 114 for the twist-preventing element 19, 119, which is arranged between the blocking plate 27, 127 and the intermediate bottom 21, 121, is provided with a linearly extending transmitting element 54, 154, which extends along the closure cap axis 55, 155, penetrates the overpressure valve body 12, 112, including the sealing diaphragm 43, 143, and is joined in or on the far side of a central continuous opening 49, 149 in the bottom with the container, not shown. The transmitting element 54, 154 is used for transmitting the pressure or temperature conditions in the container interior to the pressure-controlled or thermally-controlled drive mechanism 14, 114 of the twist-preventing element 19, 119. The transmitting element 54, 154 is embodied in the manner of a hollow or solid rod, and the section facing the twist-preventing element 19, 119 has a larger diameter than the section, adjoining it and ending in the opening 49 in the bottom 38, 138, underneath the overpressure valve body 12, 112. The inner circumferential region or in other words the radially innermost sealing face 58, 158 of the sealing diaphragm 43, 143 of the overpressure valve body 12, 112 is sealingly maintained on the thus-formed annular shoulder 56, 156 of the transmitting element 54, 154, at least when normal pressure or overpressure prevails in the container interior. In the upper section of larger diameter, the transmitting element 54, 154 is used for guiding a guide sleeve 46, 146, which surrounds it, of the overpressure valve body 12, 112.

In the exemplary embodiment of FIG. 1, and the drive mechanism is pressure-controlled, the transmitting element 54 is embodied as a hollow rod 54 with a through-bore, whose access opening is located in the plane of the bottom 38. On the side facing away from the bottom 38, the hollow rod 54 is provided with a flange 57, which rests on the intermediate body 21 of the closure element 17. On the side of the flange 57 facing the blocking plate 27, a diaphragm 50 constituting the drive mechanism 14 is maintained, its outer circumferential side being clamped in a pressure-proof manner. In the unpressured initial position shown in the right half-section in FIG. 1, the diaphragm 50 which seals the container interior in a pressure-proof manner against the grip element 18 rests centrally on the flange 57 and covers the through-bore 56 of the hollow rod 54. In an annular area between said center area 51 and its clamped area, the diaphragm 50 is provided with an annular bulge 52, which makes possible the axial deflection of the center area 51 of the diaphragm 50. The center area 51 of the diaphragm 50 is pressed against the flange 57 by the action of the compression spring on the blocking plate 27.

In this exemplary embodiment, the flange 57 is retained in a manner fixed against relative rotation on the outer circumference by hooks that engage the false bottom 21 of the closure element 17.

In the exemplary embodiment of FIG. 2, the drive mechanism 114 is constituted by a thermo-capsule 150, which rests with its outer rim on the intermediate bottom 121 of the closure element 117, and on which the center area of the blocking plate 127 rests centrally by the action of the compression spring 126. The bottom of the thermo-capsule 150 makes a transition into an elongated, hollow thermal extension 154', which is closed at the end and is disposed inside the hollow rod 154 and protrudes past the bottom 138 of the valve cap 136. The thermo-capsule 150 and the extension 154' contain an expandable material, which expands under the effect of heat in case of a temperature increase. The extension 154' can also be embodied as a solid rod and can transmit the heat from the container interior to the thermo-capsule 150.

The underpressure valve body 13, 113 is embodied differently in the two embodiments. It is understood that the underpressure valve body 13, 113 described for one exemplary embodiment can also be realized in the other exemplary embodiment.

The underpressure valve body 13 shown in FIG. 1, which is embodied as a separate component from the overpressure valve body 12, is designed as integrated with the blocking plate 27 of the twist-prevention device 19. The blocking plate 27, like the diaphragm 50, has a central opening 32, which is penetrated by the underpressure valve body 13. The underpressure valve body 13, on its lower end, has a shoulder 67 with an annular sealing face 65, which is pressed against the underside of the diaphragm 50 by the action of the compression spring 66. The head 68, protruding from the shoulder 67 provided with the annular sealing face 65, of the underpressure valve body 13 protrudes outward past the top of the blocking plate 27 and is provided there with an undercut, in which the compression spring 66 is braced on one end, while on its other end the compression spring 66 rests on the top of the blocking plate 27. The underpressure valve body 13 thus moves in the axial direction together with the blocking plate 27. In the rotationally locked position of the blocking plate 27 shown in the right half-section of the section in FIG. 1, the underside of the shoulder 67 of the underpressure valve body 13 plunges into a region of the through bore, which bore is funnel-shaped here, of the pressure-transmitting element 54. In this way, when negative pressure prevails in the container interior, the underpressure valve body 13 can lift with its annular sealing face 65 away from the diaphragm 50, counter to the action of the compression spring 66, so that a pressure equilibrium can be brought about.

The underpressure valve body 113 of FIG. 2 is integrated with the overpressure valve body 112, or its sealing diaphragm 143. While in the exemplary embodiment of FIG. 1, the inner sealing face 58 of the sealing diaphragm 43, resting on the annular shoulder 56, is retained in fixed fashion by a ring 45 braced on the bottom 38 of the valve cup 36, in the exemplary embodiment of FIG. 2 the radially inner annular sealing face 158 is pressed by a compression spring 166 against the annular shoulder 156. The compression spring 166, which is braced on the bottom part 138, is adjusted such that when negative pressure prevails in the container interior, the annular sealing face 158 of the underpressure valve body 113 lifts from the annular shoulder 156 counter to the action of the compression spring 166, so that a pressure equilibrium can be brought about.

The coolant will be heated while the engine is operated, so that the temperature or the pressure rises in the container. In accordance with the left half-section of FIG. 1, the diaphragm 40 is deflected during a pressure increase by the transmitting element 54, 154, which is connected with the drive mechanism 14, 114, and is moved axially in the direction of the arrow B against the action of the compression spring 44, while in the exemplary embodiment in accordance with FIG. 2, left half-section, the expandable material is expanded because of the temperature increase and the thermo-capsule 150 expands axially in the direction of the arrow B against the action of the compression spring 144. In both cases is the blocking plate 27, 127 lifted in the direction of the arrow B, while compressing the compression spring 44, 144, so that the prongs 28, 128 are released in the axial direction from between the retaining prongs 30, 130. In this state, the connection, fixed against relative rotation, between the grip element 18, 118 and the closure element 17, 117 is released, so that the grip element freely rotates in respect to the closure element. This free-wheeling connection between the grip element 18, 118 and the closure element 17, 117 prevents the unscrewing of the closure cap 10, 110 from the container neck. If normal output values for the pressure or temperature again prevail in the container interior, the twist-preventing element 19, 119 comes again into its initial position by means of the action of the compression spring 44, 144, so that the closure cap 10, 110 can again be unscrewed because of the connection, fixed against relative rotation, between the grip element 18, 118 and the closure element 17, 117.

The invention claimed is:

1. A closure cap for a fixed neck of a container, in particular a motor vehicle radiator, having:

an outer cap element;

an inner cap element, said outer cap element having a closure element for the container neck and a grip element, which can be rotated in relation to the latter;

a twist-prevention device which acts between said grip element and said closure element, said inner cap element having a flow connection between the interior of the container and the exterior of the container;

a valve arrangement for releasing or blocking the flow connection, which valve arrangement has an axially movable overpressure valve body, which is pressed under initial tension toward the interior of the container against a seal at said inner cap element in such a way that, when a threshold value of the interior container pressure is exceeded, it can be lifted off the seal;

an underpressure valve body; and a thermally or pressure-controlled drive mechanism in the form of a capsule made of an expandable material or of a diaphragm, wherein:

said twist-preventing element is disengaged by means of said thermally or pressure-controlled drive mechanism;

said drive mechanism is arranged in said outer cap element and is provided with a linearly extending transmitting element, which penetrates said overpressure valve body in the cap axis and extends into the area of said inner cap element which is connected with the neck of the container; and said underpressure valve body is arranged concentrically with respect to the cap axis.

2. The closure cap of claim 1, wherein: said underpressure valve body is integrated with said twist-prevention device.

3. The closure cap of claim 1, wherein: said twist-prevention device is formed by a blocking plate, in the middle region of which, oriented toward said pressure-controlled or thermally-controlled drive mechanism, the said underpressure valve body is retained in axially spring-loaded fashion.

4. The closure cap of claim 3, wherein:

said underpressure valve body is retained axially movably in a central bore in said blocking plates, and a compression spring acting between said underpressure valve body and the top of said blocking plate presses an annular sealing face of said underpressure valve body against the underside of said blocking plate.

5. The closure cap of claim 1, wherein:

said underpressure valve body surround said elongated pressure- or temperature-transmitting element, preferably near the free end of said inner cap element.

6. The closure cap of claim 1, wherein:

said underpressure valve body is integrated with said overpressure valve body.

7. The closure cap of claim 1, wherein:

said pressure- or transmitting element is embodied as a hollow or solid rod, along whose outer circumference said overpressure valve body, prestressed by an axial compression spring, is guided.

8. The closure cap of claim 1, wherein:

between an annular sealing seat for said overpressure valve body, on a centrally pierced bottom of said inner cap element, and an underside facing away from said axial compression spring, of said overpressure valve body, the liftable outer circumferential region of a sealing diaphragm is disposed, whose inner circumferential region brings about an over pressure sealing that is constantly axially operative for the overpressure valve body between said overpressure valve body and said elongated pressure- or temperature-transmitting element.

9. The closure cap of claim 6, wherein:

said inner circumferential region of said sealing diaphragm can be lifted away counter to the action of a compression spring that acts in the direction of an overpressure.

10. The closure cap of claim 9, wherein:

said inner circumferential region of said sealing diaphragm is pressed against a shoulder of said elongated pressure- or temperature-transmitting element; and said compression spring is braced on the bottom of said inner cap element.

11. The closure cap of claim 7, wherein:

said pressure- or pressure-transmitting element penetrates the bottom of said inner cap element.

12. The closure cap of claim 7, wherein:

said pressure-transmitting element has a through bore, whose inlet side, toward the container, discharges at the bottom of said inner cap element, and whose outside, remote from the container, is covered by said diaphragm.

13. The closure cap of claim 1, wherein:

said diaphragm, with it central region, is opposite the outlet side of said through bore, and is fastened in place in pressure-proof fashion on the outer circumference, and on the inner circumference rests between the underside of said blocking plate and the annular sealing face of said underpressure valve body.

14. The closure cap of claim 13, wherein:

said diaphragm is fastened in place on the circumferential region of an end flange of said pressure-transmitting element.

15. The closure cap of claim 1, wherein:

said inner cap element has a centrally pierced false bottom, on the top of which said flange, provided with said diaphragm, or the capsule made of expandable material rests, and from whose underside said valve arrangement is suspended.

16. The closure cap of claim 3, wherein:

said blocking plate is connected nonrotatably but axially movably to the said closure element; and radially outward-pointing prongs of said blocking plate become engaged between radially inward-pointing prongs of said grip element.

* * * * *